United States Patent [19]

Hudson

[11] 3,961,193

[45] June 1, 1976

[54] SELF ADJUSTING CORONA DEVICE

[75] Inventor: Frederick W. Hudson, West Henrietta, N.Y.

[73] Assignee: Xerox Corporation, Stamford, Conn.

[22] Filed: May 27, 1975

[21] Appl. No.: 581,382

[52] U.S. Cl. ..... 250/324; 250/325; 317/262 A

[51] Int. Cl.[2] ..... H01T 19/24

[58] Field of Search ..... 250/324, 325, 326; 317/262 A

[56] References Cited

UNITED STATES PATENTS

| | | | |
|---|---|---|---|
| 3,068,356 | 12/1962 | Codichini | 250/326 |
| 3,335,273 | 8/1967 | Walkup | 250/326 |
| 3,489,895 | 1/1970 | Hollberg | 250/324 |
| 3,604,925 | 9/1971 | Snelling | 250/326 |
| 3,764,883 | 10/1973 | Staad | 250/324 |

*Primary Examiner*—Alfred E. Smith
*Assistant Examiner*—B. C. Anderson

[57] ABSTRACT

An electrostatic charging apparatus in which current reaching an imaging surface from a corona discharge device is automatically regulated. A sensing means is provided to measure the charging current delivered to the imaging surface and means responsive to said measured charging current to adjust the D.C. bias of an A.C. power supply energizing the corona electrode.

2 Claims, 2 Drawing Figures

SELF ADJUSTING CORONA DEVICE

BACKGROUND OF THE INVENTION

This invention relates to methods and apparatus for electrostatically charging a surface and more particularly to improved corona generating methods and apparatus therefore usable in electrostatic recording and reproducing equipment or in any other application where it is desirable to efficiently charge a selective medium in a controlled manner.

In electrostatic recording and reproducing processes, such as the electrophotographic process known as xerography, it is necessary to sensitize a photoreceptor structure by charging at least one surface thereof to a potential which is preferably uniform. Subsequent to or simultaneously with the sensitizing of the photoreceptor structure in such electrophotographic processes, the photoreceptor structure is exposed so that a photosensitive layer therein is rendered selectively condutive whereupon a latent electrostatic image is formed which may be then developed using conventional electrophotographic techniques. The developed image is then transferred onto a copy sheet on which it is rendered permanent by means of a fixing process.

In the above-noted electrophotographic process, electrostatic charging techniques are generally relied on to accomplish such necessary processing steps as laying down of an initial charge on an imaging surface, the transfer of an electrostatically toner image from a reusable photoreceptor structure to a transfer member, the tacking and stripping operations associated with such transfer member, and various other conditioning processes whereby charges are improved or modified on a xerographic medium.

While many forms of acceptable techniques for electrostatically charging a surface are known, corona discharge techniques have generally been preferred in applications such as those mentioned above because such techniques are particularly well suited to applying an electrostatic charge to a moving surface and the use of corona discharge techniques allows for a selected surface to be rapidly charged to a relatively high potential. Furthermore, since corona generating apparatus generally employ a wire like electrode, they are advantageous because the charging process acts to impose a potential level on the surface being charged which tends to be more uniform than that obtained from other surface charging techniques. Conventional forms of corona generating apparatus are illustrated in U.S. Pat. Nos. 2,836,725 and 2,879,395 and generally comprise one or more wire like electrodes, known as coronodes, horizontally disposed above the surface to be charged and a shield which is usually a conductive member which may take a plurality of different structural forms, partially disposed about the coronode. In one conventional mode of operation, a high voltage D.C. power supply is connected to the coronode with the requisite polarity for the charging operation which is desired, while a conductive layer associated with the surface to be charged is grounded, as are the other terminal of the power supply and the shield.

Another form of energization for corona discharge devices of the above-noted type is disclosed in U.S. Pat. Nos. 2,777,957 and 2,879,395 wherein an elongated coronode is coupled to an alternating current source, while concurrently grounding the substrate on which the surface to be charged rests. Control of the charge deposited by such an arrangement is achieved by using a so-called scorotron grid biased to a D.C. potential and located between the coronode and the surface to be charged. Alternately, the shield may be held at a specific potential above ground while applying an A.C. signal to the coronode.

In any of the above-noted arrangements, it is well known to those skilled in the art that the magnitude of the charging current delivered at any given moment to the photoconductive surface is effected by many factors among which are the potential of the surface below the corona discharge device and ambient conditions of relative humidity, temperature, etc.

Arrangements for achieving dynamic control of the rate at which charge is deposited by a corona discharge device onto a photoconductive surface are desirable. Several prior art methods of accomplishing this are known.

In U.S. Pat. No. 3,062,956, the scorotron grid or screen, which is interposed between the coronode and the imaging surface, is held at a D.C. bias potential which is varied in response to charging current to maintain the charging current constant.

In U.S. Pat. No. 3,335,274 there is disclosed a feedback arrangement in which the charging current to the imaging surface is monitored and made to control the high voltage potential applied to the coronodes, to thereby hold the charging current constant. This arrangement has the disadvantage of requiring the control of relatively high voltages which are used to energize the coronodes.

U.S. Pat. No. 3,335,275 is of interest in that it shows an arrangement for terminating the charging action of a corona device when the potential of the surface to be charged reaches a preselected value.

It has also been known that a D.C. bias may be superimposed on a corona discharge device energized by applying an A.C. signal to its coronodes, as shown in U.S. Pat. No. 3,275,837. In connection with such biasing arrangements, it is further known to those skilled in the art that the charging current delivered to an imaging surface from a D.C. biased A.C. energized corona device may be varied by changing the value of this D.C. bias.

Copending commonly assigned application, Ser. No. 491,895, discloses an arrangement whereby the D.C. bias on an A.C. pretransfer corona device may be changed in response to manual selection by a xerographic machine operator in order to improve copy quality.

Copending application Ser. No. 531,131 also commonly assigned, discloses a control arrangement for a corona device of a xerographic machine wherein the D.C. biasing voltage applied to the corona generator shield is varied in response to a signal detected by a voltage response electrometer probe.

SUMMARY AND OBJECTS OF THE INVENTION

An object of the invention is to provide a biasing arrangement for producing a constant current from a D.C. biased A.C. energized corona device.

It is a further object of the present invention to provide an improved corona generating arrangement controlling the charging of the photosensitive member of a copier without necessitating the changing of the corona producing voltages applied to the corona emissions wire.

It is an object of the present invention to provide a corona charge control arrangement wherein the corona charging current is held constant despite changes in the operating conditions by controlling the D.C. bias level applied to an A.C. energized corona device.

These objects and others are accomplished by providing a corona discharge device having a coronode positioned within a conductive shield, the device being located adjacent an imaging surface to be charged by a constant charging current. The charging current is monitored by grounding the conductive substrate on which the imaging surface is deposited through a current measuring or current indicative device, the output of which is fed back to control a D.C. power supply which changes the bias about which the A.C. energizing signal applied to the corona wire oscillates.

BRIEF DESCRIPTION OF THE ILLUSTRATED EMBODIMENTS

DESCRIPTION OF THE PREFERRED EMBODIMENT

Figure 1:
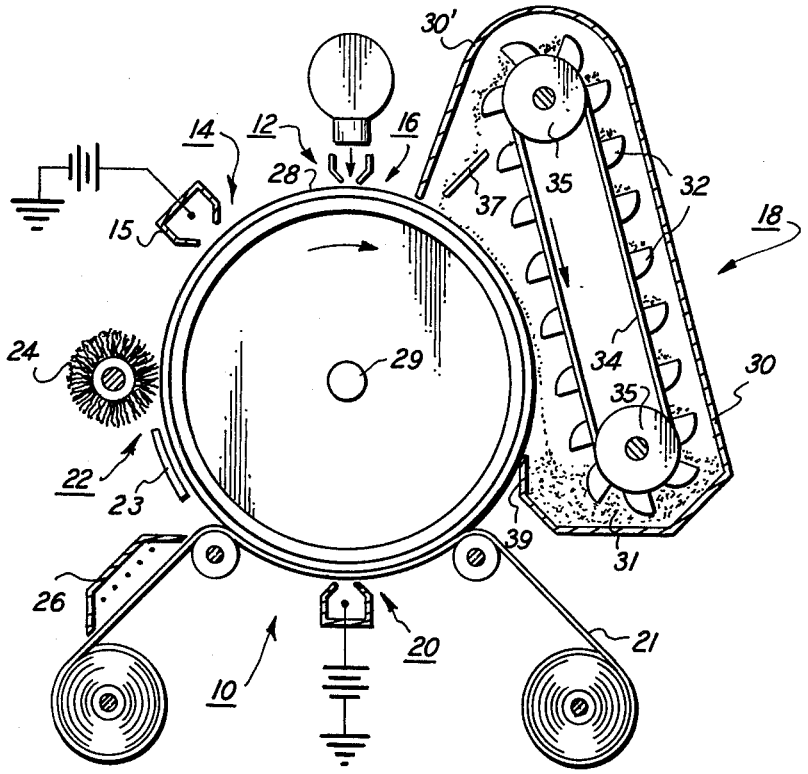
FIG. 1 is a schematic drawing of an exemplary xerographic machine.

Referring to FIG. 1 of the drawings, there is shown an exemplary xerographic machine, designated generally by the numeral 10, into which a charge control arrangement embodying the principles of the present invention may be incorporated. Referring thereto, a series of processing stations are provided about the periphery of xerographic drum 12 as follows:

A charging station 14, at which a uniform electrostatic charge is deposited on the photoconductive layer of the xerographic drum 12 by a suitable corona generating means, such as corotron 15;

An exposure station 16, at which the light or radiation pattern of copy to be reproduced is projected onto the photoconductive surface of drum 12 to selectively dissipate, in accordance with the copy image pattern, the charge on the drum surface to thereby form a latent electrostatic pattern of the copy to be reproduced;

A development station 18, at which a xerographic developing material including toner powder having an electrostatic charge opposite to that of the latent electrostatic image on the photoconductive surface of drum 12 is brought into contact with the drum surface, the toner powder adhering to the latent electrostatic image to form a xerographic powdered image in the configuration of the copy being reproduced;

A transfer station 20, at which the xerographic powdered image is electrostatically transferred from the drum surface to a suitable support surface such as web 21; and A drum cleaning station 22 at which the surface of drum 12 is brushed to remove residual toner particles remaining thereon after image transfer. To facilitate cleaning of drum 12, a fadeout or exposure lamp 23 may be provided to discharge any residual charges on the drum photoconductive surface in preparation for cleaning by a suitable brush 24.

A suitable fixing device or fuser 26 is provided to permanently fix the toner image on web 21.

The aforesaid stations are operatively disposed about the xerographic surface of drum 12 upon which the images are to be formed. The photoconductive or xerographic surface of drum 12 designated here by the numeral 28 may comprise any suitable photoconductive material such as selenium. Shaft 29 of drum 12 is suitably supported for rotational movement, suitable drive means (not shown) being provided to turn drum 12 in the direction indicated by the solid line arrow as well as for initiating the cycle of operation for the various processing stations described heretofore. While the photoconductive surface for the xerographic machine 10 has been illustrated as a drum, it will be understood that other types of surface such as a belt, may instead be used.

The developing instrumentalities of development station 18 are encased in a general developer housing 30. The lower or sump portion 31 of the developer housing 30 is adapted to be filled with a quantity of two component developer material. The developer may be raised to an elevated position for cascading down the xerographic surface by a series of buckets 32 on a movable belt 34 and guided for its motion by rollers 35. Power may be imparted to the rollers by any conventional power source, not shown, to move the buckets in the direction as indicated by the arrows.

As the buckets reach their uppermost position, they are adapted to release the developer through a throat-like opening, formed by the depending edge 30' of the developer housing 30 and internal guide plate 37, for guiding the developer onto the surface 28 of the drum 12. Sump 31, buckets 32, and plate 37 extend a width approximately equal to the width of the drum 12 to insure the cascading of developer across the entire width of the photoconductive surface 28. As the developer cascades down the arc of the drum, the latent electrostatic image therebelow on the drum surface 28 is developed. As the developer material falls past the horizontal center line of drum 12, the effect of gravity drops unused developer material onto the pick off baffle 39 and back into the sump 31 for recycling. A toner dispenser (not shown) may be provided with developer housing 30 for supplementing the toner given up by the system through development of images.

In operation, the photoconductive surface 28 of drum 12 is normally charged to a predetermined positive level by corotron 15 following which the charged photoconductive surface is exposed at exposure station 16 to a light reflected image of the original being copied. Such exposure results in selective discharge of the photoconductive surface 28 in conformance with the image presented by the original of the photoconductive surface as described earlier. The photoconductive surface, being the latent electrostatic image, is thereafter, developed at development station 18. The development material, which is the present example would use negative toner, is electrostatically attracted to and held on the photoconductive surface 28 by the positive charges thereon, the intensity of such charges being in accordance with and in proportion to the image outline. The developed image is thereafter transferred to web 21 following which the image on web 21 is fixed by fuser 26 to render the image permanent.

Figure 2:
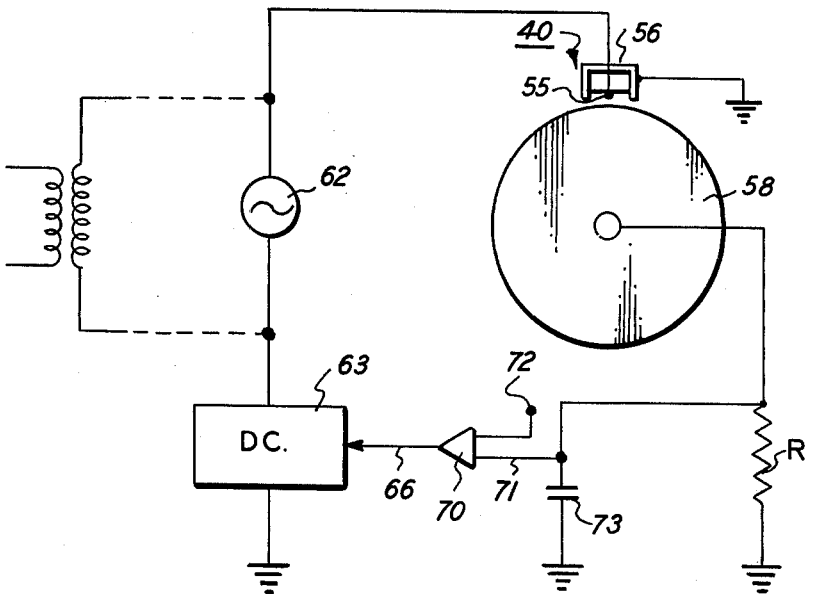
FIG. 2 is an illustration of the operation of the constant current charging arrangement according to the invention.

Referring now to FIG. 2, there is shown the charge control arrangement of the invention embodied in a xerographic machine. A corona device 40 comprising a corona discharge wire or emitter 55 suitably enclosed in a generally U-shaped conductive shield 56 is located adjacent an imaging surface 58. The imaging surface 58 may include a photoconductive surface deposited on a conductive substrate, as is well known in the art. The conductive substrate of the imaging surface is coupled to ground through the parallel combination of a resistor 59 and a capacitor 73 so that charging current received by the surface 58 is made to flow therethrough. The voltage across this parallel combination is therefore related to the charging current according to Ohm's law.

The coronode wire 55 of the corona device 40 is energized by an A.C. source 62 which is biased to a D.C. potential by a suitable biasing arrangement 63. The A.C. source may be the secondary of a transformer coupled to an ordinary commercial power outlet of 115V at 60 cycles, as shown in the dotted lines. The turns ratio of transformer is selected to provide a corona generating voltage to the wire 55 in a manner similar to that disclosed more specifically in the aforementioned U.S. Pat. Nos. 3,062,956 and 2,879,395.

The D.C. biasing supply 63 is of a type which is variable in response to a control signal developed on line 66, which comprises the output of a comparator 70. The comparator 70 has first and second inputs 71 and 72. Input 72 is from an adjustable D.C. reference potential, which is selected to adjust the charging current to any preselected value. The input 71 is coupled across the capacitor 73 which as mentioned hereinbefore, charges to a voltage representative of the value of the charging current to the imaging surface.

In operation, the reference potential applied to input 72 of comparator 70 is adjusted (given the magnitudes of the A.C. source and an initial D.C. bias supplied to the corona wire 55) so that a charging current suitable for depositing a selected charge on the imaging surface is produced. The output of the comparator 70 under these conditions is adjusted to maintain the above noted initial D.C. bias from the source 63. The above parameters are maintained as long as conditions such as temperature, humidity, pressure, voltage potential on the plate, spacings, etc. are maintained. In the event there is any change in any of these conditions, there will be a corresponding variation in the corona charging current which would be reflected as a change in the voltage across capacitor 73 and a corresponding change in output from comparator 70. This change in output from comparator 70 controls the D.C. bias supply 63 to bring about a return to the initial conditions. Thus, if charging current decreases the output of comparator 70 increases, which decreases the D.C. bias level and thereby increases the charging current output.

The direction and magnitude of the changes in the D.C. supply needed to restore initial conditions is dependent on the magnitude of the A.C. supply used and the specific corona structure employed. Circuitry suitable for the feedback arrangements is well known in the art, the arrangement of U.S. Pat. No. 3,604,925 and those in the aforementioned patents being suitable for this purpose.

By the present invention, automatic control over the charging current deposited by an A.C. energized corona device is obtained by adjusting the magnitude of the D.C. bias potential applied to the coronode.

While the invention has been described with reference to the structure disclosed, it is not confined to the details set forth, but is intended to cover such changes and modifications as may come within the scope of the appended claims.

What is claimed is:

1. An arrangement for regulating the charging current deposited by a corona discharge device onto an imaging surface wherein said device includes a coronode, partially surrounded by a conductive shield comprising energizing means for applying corona generating A.C. signal to said coronode, bias means for superimposing a D.C. bias onto said coronode, control means for generating a signal representative of the difference between said charging current delivered to said surface and a reference current, and bias control means for varying said D.C. bias to thereby vary said charging current in response to said control signal.

2. The combination recited in claim 1 wherein said imaging surface is supported by a conductive substrate, said substrate coupled to ground through a charging current responsive element.

* * * * *